United States Patent [19]

Forster

[11] Patent Number: 4,475,443

[45] Date of Patent: Oct. 9, 1984

[54] AXIAL PISTON MACHINE WITH SUCTION LINE IMPURITY TRAP

[75] Inventor: Franz Forster, Muhlbach, Fed. Rep. of Germany

[73] Assignee: Linde Aktiengesellschaft, Hollriegelskreuth, Fed. Rep. of Germany

[21] Appl. No.: 380,130

[22] Filed: May 20, 1982

[30] Foreign Application Priority Data

May 22, 1981 [DE] Fed. Rep. of Germany ..... 3120334

[51] Int. Cl.[3] ..... F01B 13/04; F15B 21/04

[52] U.S. Cl. ..... 91/499; 92/78; 60/454; 210/416.1

[58] Field of Search ..... 417/313; 92/78; 60/453, 60/454; 415/121 G; 91/499; 210/416.1, 416.4, 416.5

[56] References Cited

U.S. PATENT DOCUMENTS

| | | | |
|---|---|---|---|
| 1,750,170 | 3/1930 | Frisch | 417/238 |
| 2,280,392 | 4/1942 | Herman et al. | 417/238 |
| 2,286,301 | 6/1942 | Parsons | 210/416.4 |
| 2,968,248 | 1/1961 | Carter | 415/121 G |
| 3,643,434 | 2/1972 | Widmaier | 417/429 |
| 3,866,518 | 2/1975 | Miyao et al. | 91/488 |
| 3,924,515 | 12/1975 | Clerk | 91/472 |
| 3,975,990 | 8/1976 | Kraus | 91/499 |
| 3,980,003 | 9/1976 | Huebner et al. | 91/487 |

FOREIGN PATENT DOCUMENTS

| | | | |
|---|---|---|---|
| 471368 | 5/1952 | Italy | 60/454 |
| 54-123716 | 9/1979 | Japan | 417/313 |

*Primary Examiner*—William L. Freeh
*Assistant Examiner*—Paul F. Neils
*Attorney, Agent, or Firm*—Buell, Blenko, Ziesenheim & Beck

[57] ABSTRACT

An axial piston pump is provided having a cylinder drum, the end face of which lies against a control bottom pickup element, in which an approximately semi-circular suction channel and an approximately semi-circular pressure channel are located, where each of these two channels extend in the control bottom pickup element to a connection opening, in which case a device for trapping impurities, preferably a sieve, is installed in the suction channel inside of the control bottom pickup element.

4 Claims, 4 Drawing Figures

AXIAL PISTON MACHINE WITH SUCTION LINE IMPURITY TRAP

This invention relates to swash plate machines and particularly to a hydrostatic axial machine, commonly called an axial piston machine, such as a swash plate pump, a wobbler pump, or a bent axis pump, with protection against contamination in the stream of working medium, which preferably is an oil, and with a cylinder drum, the front face of which lies against a control bottom in which an approximately semi-circular suction channel and an approximately semi-circular pressure channel are located, where each of these two channels extends in the control bottom in a corresponding channel up to a connection and whereby a device for trapping impurities is provided for protection against dirt. The invention concerns protection against coarse dirt in the main stream of suction pumps, especially those of the tapered washer type. It has been quite conventional to date to install a filter in the stream flowing back to the tank so that particles that became detached in the pump or in the consumer fed by it are trapped in the filter and do not get into the collection receptacle for the working medium. Impurities that get into the receptacle from outside can be drawn out of it by suction and thus get into the flow of pressure medium, into the pump, and into the consumer. The installation of a large-volume suction filter in the suction line to the pump is also known. Since a pressure gradient develops in any filter, the suction conditions are thus adversely affected and the danger of cavitation is thus increased at high r.p.m.'s, which in turn reduces the maximum admissible r.p.m. Difficulties also arise under cold-start conditions at a high viscosity of the oil, since a change from laminar to turbulent flow can occur in the oil steam behind the filter in this case. There is also the relatively high expense for an additional suction filter.

The purpose of the invention is to provide a protection device against coarse impurities with the lowest possible expense, which reliably protects the pump against the aspiration of impurities, including those that may remain in the pipes leading to the pump during assembly.

The problem is solved by the features specified in the characterizing section of claim 1. The incorporation of the protective device, which can be a sieve for example, directly in the channel inside of the control bottom pickup element is thus new. Depending on the design of this channel in the control bottom pickup element, various refinements of the arrangement of the dirt-trapping device, in particular, the sieve, and refinements of the latter are possible. Through the inventive arrangement of the sieve in the suction channel and/or in the control bottom pickup element, not only the drive mechanism components, i.e., primarily the piston in the running surface of the cylinder, the shoes on the tapered washer, and the control surfaces of the cylinder drum on the control bottom, but also the adjustment and regulating elements, in particular, nozzles and the valve elements, are effectively protected against breakdown or a shortened service life. Impurities that get into the system during assembly or during installation of the piping are also trapped here.

The device, e.g., sieve, should be installed so that the oil flow can be distributed as uniformly as possible on the effective surface of the device, e.g., sieve surface. In order to advantageously facilitate this, it may be expedient if the suction connection at the outer surface of the control bottom pickup element is located on the opposite side of this element, such as the side of the axis of rotation, on which the approximately semi-circular suction channel is located, so that the suction channel and pressure channel are appropriately conducted past each other in the control bottom pickup element. It is also advantageous for the possibility of connecting an additional pump or attaching a valve housing if the suction and pressure connections lie on a plane lying at right angles to the axis of rotation, especially if they lie in a common flange surface alongside each other.

In the foregoing general description of this invention certain objects, purposes and advantages have been set out. Other objects, purposes and advantages of this invention will be apparent from a consideration of the following description and the accompanying drawings in which.

Figure 1:
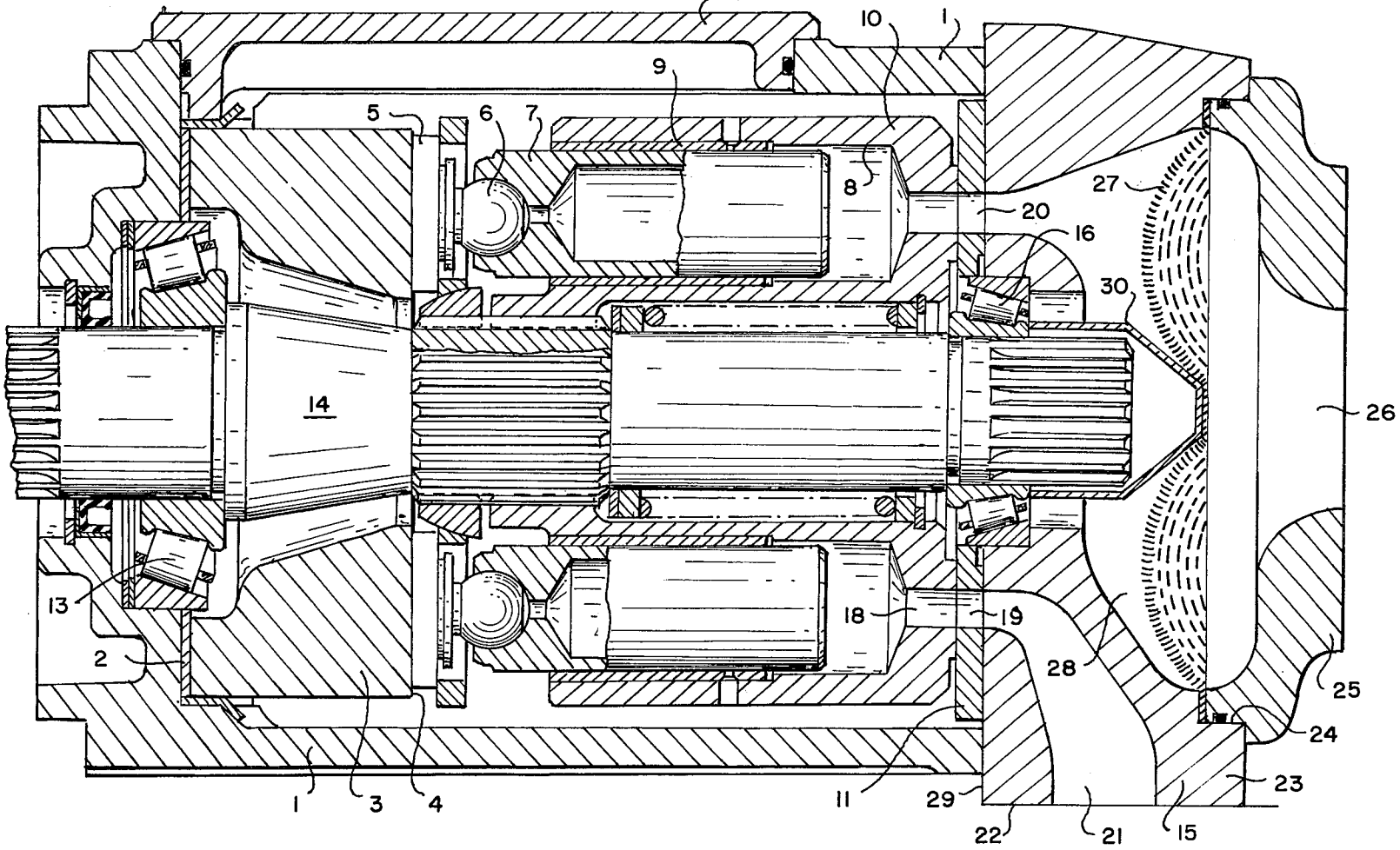
FIG. 1 shows in axial section a tapered plate axial piston pump with the connection of the suction line coaxial to the axis of rotation.

The housing 1 of the axial piston pump contains a semi-cylindrical sliding surface 2, in which the rocker 3 is supported. The tapered plate 4 is formed on the front face of the latter and the shoes 5 lie against this tapered plate. The shoes 5 are each provided with a ball end 6, against which a piston 7 is supported. Each piston 7 is capable of sliding in a sleeve 9 in a cylinder bore 8. The cylinder bores 8 are provided in a cylinder drum 10, which lies with its front face against a control bottom 11.

An opening in the housing 1 that serves for assembly is closed by a cover 12. One end of the shaft 14, which is connected in a rotation-fast manner with the cylinder drum 10, is supported in the roller bearing 13. In a manner not shown in the drawing, the control bottom pickup element 15 is connected with the housing 1 in a detachable manner, but solidly during operation. The roller bearing 16, in which the second end of the drive shaft 14 is supported, is supported in the control bottom pickup element 15. The drive shaft 14 has toothing at both ends for slipping on a torque transfer coupling.

Each cylinder bore 8 is connected with an opening bore 18, which empties in the end face of the cylinder drum 10 (on the right-hand side in the drawing). Two approximately semi-circular channels 19 and 20 are formed in the control bottom 11 in front of these openings of the channels 18, of which channel 19 is always the pressure connection into which the fluid is forced out of the cylinders 8 and the channel 20 is always the suction connection, through which the fluid is aspirated into the cylinder 8.

A channel 21 that leads to a connection in the flange face 22 is formed in the control bottom pickup element 15.

At its end face the control bottom pickup element 15 has another flange face 23, which is provided with a centering bore 24, which serves, in case of need, to connect an additional pump or other energy consumer, the shaft of which is connected with the shaft 14. In the present case a cover 25 is instead placed on it; this cover is connected with the control bottom pickup element 15 by means of bolts (not shown in the drawing) and it has a suction opening 26.

A sieve 27 is clamped at its edge between the opposing surfaces of the control bottom pickup element 15 and the cover 25 and arranged so that the fluid coming from the suction opening 26 can flow into the suction chamber 28 formed in the control bottom pickup element only through the sieve 27. The suction chamber 28 is designed so that it empties in the end face 29 of the control bottom pickup element 15 precisely in front of the approximately semi-circular suction channel 20.

In order to avoid unnecessary turbulence, a protective element 30, which is supported on the inner ring of the roller bearing 16 in the implementation example and thus rotates together with it, is installed around the end of shaft 14.

In another embodiment, it can also be provided, in order to reduce the turbulence losses even more, that a protective hood essentially corresponding to protective hood 30 is supported on the outer ring of the bearing 16 or the part of the control bottom pickup element 15 adjacent to it, such that this protective hood does not rotate with it. This not only further reduces the frictional losses in the fluid and contributes to quieting the flow in the suction chamber 28, but also makes it possible to support the sieve 27 on this hood.

Figure 2:
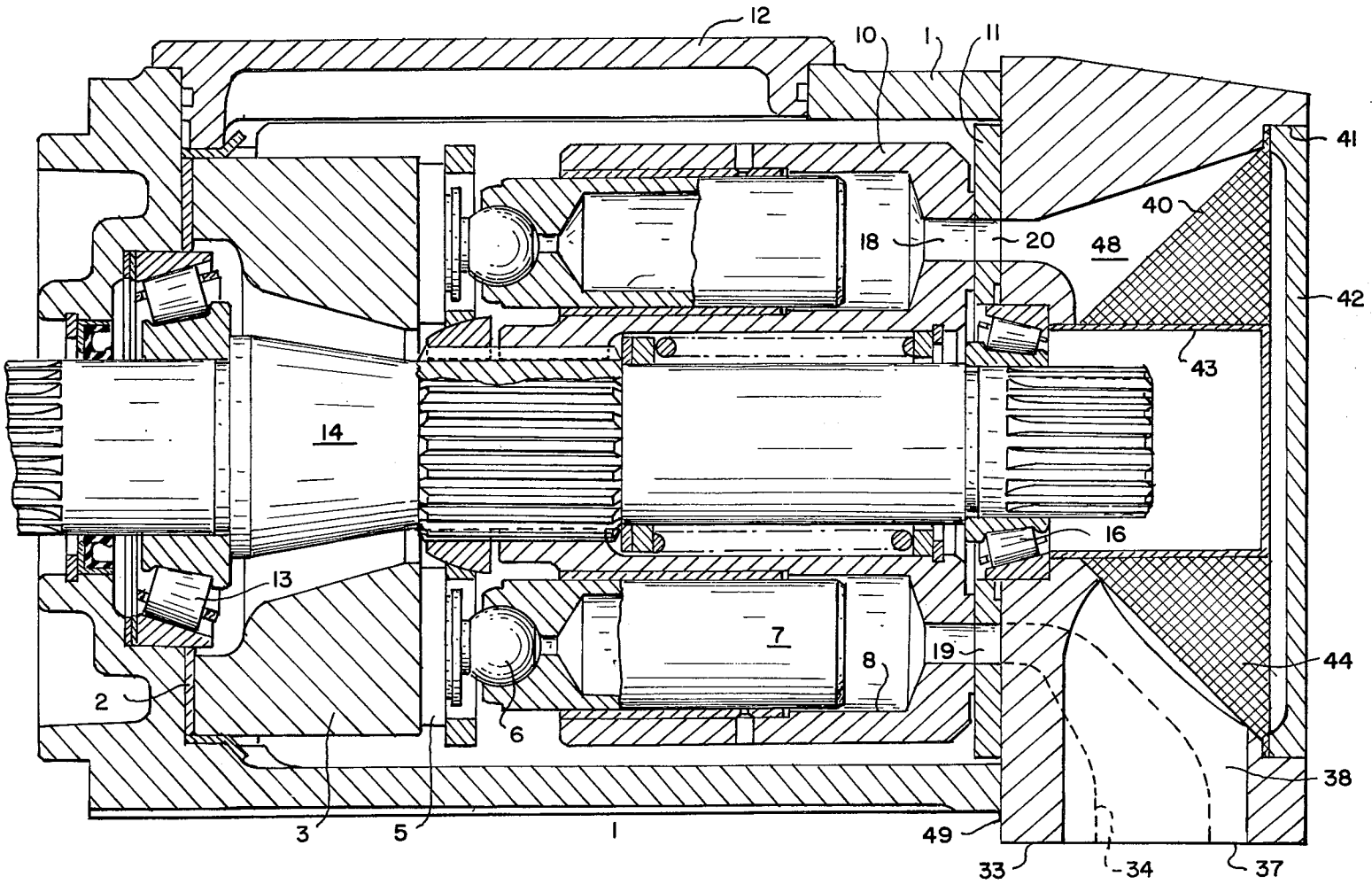
FIG. 2 shows in axial section a tapered plate axial piston pump in which the suction channel and pressure channel empty into a flange surface of the control bottom pickup element.
Figure 3:
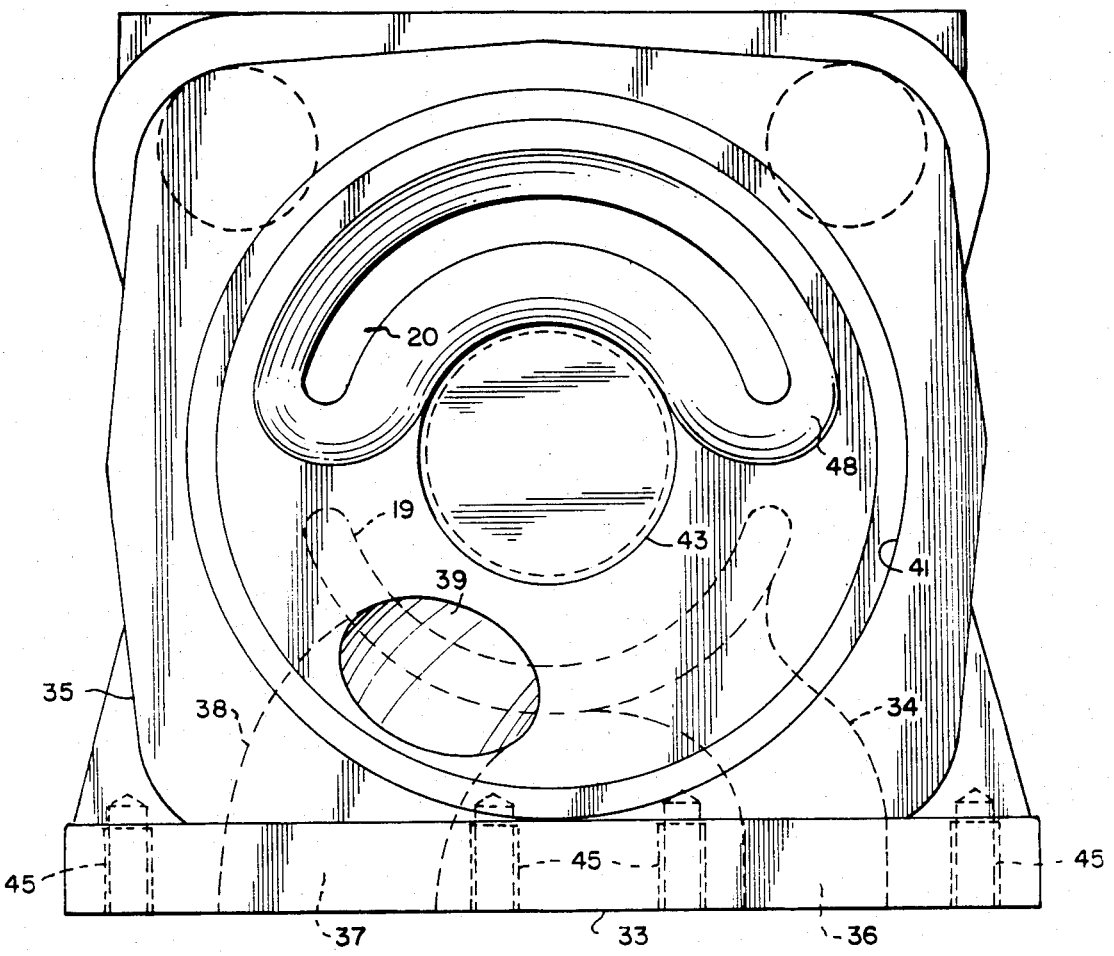
FIG. 3 shows a view of the control bottom pickup element in the axial direction.
Figure 4:
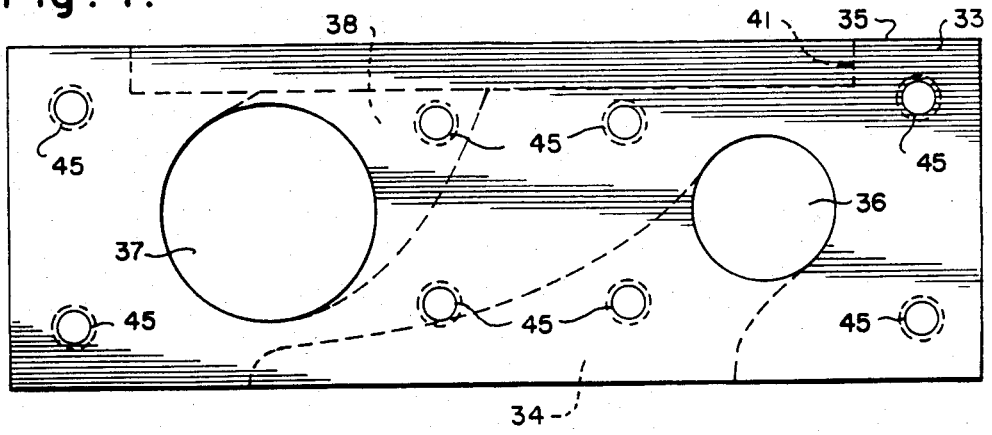
FIG. 4 shows a front view on the flange face of it.

In the implementation example shown in FIGS. 2–4, the components 1–18 are the same as the components with the same reference numbers in FIG. 1. In this case, however, the control bottom pickup element 35 is designed so that a pressure channel 34 empties in it, opposite the approximately semi-circular pressure channel 19. The channel 34 empties in the flange end face 33 of the control bottom pickup element 35 with an opening 36. A suction chamber channel 38 with an opening 37 also empties in the flange face 33 of the control bottom pickup element 35; a portion of the conical sieve 40 lies in front of the second opening 39 of the suction chamber channel 38.

A centering bore 41 is also provided in the control bottom pickup element 35; when an additional pump, which is to be connected to the shaft 14, is to be attached, this centering bore 41 serves to center it. This opening is closed off by a cover 42 in the implementation example, in which case the outer edge of the conical sieve 40 is clamped between this cover 42 and the control bottom pickup element 35.

A protective hood 43 is supported on the outer ring of the roller bearing 16 around the toothed free end of the shaft 14. The inner edge of the sieve 40 is fastened between this protective hood 43 and an inner bore in the control bottom pickup element 35.

In a zone surrounding the opening 39 the sieve 40 lies in a sealed manner against an inner conical surface of the control bottom pickup element 35, in which the opening 39 is formed. Outside of this zone in which the sieve 40 lies in a sealed manner against the control bottom pickup element 35, a suction chamber 44 is formed around the conical outer surface of the sieve 40. This suction chamber 44 is provided with an orifice in the end face 49 of the control bottom pickup element 35 that lies precisely in front of the approximately semi-circular suction channel 20.

Threaded holes 45 are provided in the control bottom pickup element 35 from the flange face 33; they are for receiving the bolts for the connecting flanges.

The fluid aspirated thus flows from the suction orifice 37 through the suction channel 38, through the sieve 40 in its inner space 44 and from here once again through the sieve into the suction chamber 48 and from here to the semi-circular suction channel 20. The sieve is thus also quite accessible for cleaning or replacement.

In the foregoing specification I have set out certain preferred embodiments and practices of my invention, however, it will be understood that this invention may be otherwise embodied within the scope of the following claims.

I claim:

1. In an axial piston machine having a cylinder drum in a housing, the front face of which drum lies at least indirectly against a control bottom pickup element, the improvement comprising, a substantially semi-circular suction channel and a spaced substantially semi-circular pressure channel located in said control bottom pickup element, said channels each extending to an external connection opening, and means in said suction channel in the control bottom pickup element for trapping impurities and wherein said pump is designed as a tapered washer pump, the shaft of which is provided with a free end for connection with an additional energy consumer, and whereby a chamber, closed by a cover, is provided around this free shaft end in the control bottom pickup element, and the means for trapping impurities is located in this chamber which forms a part of the suction channel.

2. Axial piston machine according to claim 1, characterized in that the feed connection is axial to the shaft of the axial piston machine.

3. Axial piston machine according to claim 1, characterized in that connection opening of the feed channel is located on the side of the control bottom pickup element.

4. Axial piston machine according to claim 3, characterized in that a flange face is formed on one side of the control bottom pickup element, in which flange face both the connection opening of the suction channel and the connection opening of the pressure channel are located.

* * * * *

UNITED STATES PATENT AND TRADEMARK OFFICE

CERTIFICATE OF CORRECTION

PATENT NO. : 4,475,443

DATED : October 9, 1984

INVENTOR(S) : FRANZ FORSTER

It is certified that error appears in the above-identified patent and that said Letters Patent is hereby corrected as shown below:

Column 1, line 37, change "steam" to --stream--.

Signed and Sealed this

*Eleventh* Day of *June 1985*

[SEAL]

*Attest:*

DONALD J. QUIGG

*Attesting Officer* *Acting Commissioner of Patents and Trademarks*